US010913634B2

(12) United States Patent
Eastman et al.

(10) Patent No.: US 10,913,634 B2
(45) **Date of Patent: *Feb. 9, 2021**

(54) WOVEN ELEVATOR BELT WITH MULTIFUNCTIONAL COATINGS

(71) Applicant: OTIS ELEVATOR COMPANY, Farmington, CT (US)

(72) Inventors: Scott Alan Eastman, Glastonbury, CT (US); John P. Wesson, West Hartford, CT (US); Daniel A. Mosher, Glastonbury, CT (US); Wenping Zhao, Glastonbury, CT (US); Michael Paul Humbert, Meriden, CT (US); William Eaton Holden, III, Berlin, CT (US); Brad Guilani, Woodstock Valley, CT (US); Gopal R. Krishnan, Wethersfield, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 16 days.

This patent is subject to a terminal disclaimer.

(21) Appl. No.: 15/760,046

(22) PCT Filed: Sep. 14, 2016

(86) PCT No.: PCT/US2016/051667

§ 371 (c)(1),
(2) Date: Mar. 14, 2018

(87) PCT Pub. No.: WO2017/048799

PCT Pub. Date: Mar. 23, 2017

(65) Prior Publication Data

US 2018/0251342 A1 Sep. 6, 2018

Related U.S. Application Data

(60) Provisional application No. 62/218,275, filed on Sep. 14, 2015.

(51) Int. Cl.
*B66B 7/06* (2006.01)
*D07B 1/16* (2006.01)
(Continued)

(52) U.S. Cl.
CPC ..... *B66B 7/062* (2013.01); *D07B 1/16* (2013.01); *D07B 1/22* (2013.01); *D07B 5/006* (2015.07);
(Continued)

(58) Field of Classification Search
CPC ..... D07B 2205/3007; D07B 2801/16; D07B 2801/22; D07B 2201/2087;
(Continued)

(56) References Cited

U.S. PATENT DOCUMENTS 2,766,159 A 10/1956 Adams, Jr. et al.
6,668,868 B2 12/2003 Howland et al.
(Continued)

FOREIGN PATENT DOCUMENTS

EP 0228725 A1 7/1987
EP 1886795 A1 2/2008
(Continued)

OTHER PUBLICATIONS

International Search Report for International Application No. PCT/US2016/051667; International Filing Date Sep. 14, 2016; dated Dec. 21, 2016, 5 pages.
(Continued)

*Primary Examiner* — Arti Singh-Pandey
(74) *Attorney, Agent, or Firm* — Cantor Colburn LLP

(57) ABSTRACT

A belt for suspending and/or driving an elevator car includes a plurality of tension elements extending longitudinally along a length of the belt and a plurality of fibers interlaced with the plurality of tension elements forming a composite belt structure. A coating at least partially encapsulates the
(Continued)

composite belt structure to improve two or more operational characteristics of the belt. A method of forming a belt for suspending and/or driving an elevator car includes forming a plurality of tension elements and arraying the plurality of tension elements longitudinally along a belt. A plurality of fibers are interlaced with the plurality of tension elements to form a composite belt structure. A coating is applied to at least partially encapsulate the composite belt structure to improve at least two operational characteristics of the belt.

13 Claims, 6 Drawing Sheets

(51) Int. Cl.

| | |
|---|---|
| ***D07B 1/22*** | (2006.01) |
| ***D07B 5/04*** | (2006.01) |
| ***D07B 5/00*** | (2006.01) |
| ***D07B 7/14*** | (2006.01) |

(52) U.S. Cl.
CPC ..... *D07B 5/04* (2013.01); *D07B 7/145* (2013.01); *D07B 2501/2007* (2013.01)

(58) Field of Classification Search
CPC ..... D07B 2201/2092; D07B 2401/202; D07B 2401/2025; D07B 2401/2035; D07B 2501/2007; D07B 5/006; D07B 5/04; B66B 7/062; B66B 9/00; D03D 15/0094; D03D 15/02; D03D 1/0094; D10B 2101/20; D10B 2505/02
See application file for complete search history.

(56) References Cited

U.S. PATENT DOCUMENTS

| | | | |
|---|---|---|---|
| 7,695,386 | B2 | 4/2010 | Wood et al. |
| 8,450,222 | B2 | 5/2013 | Pritchard et al. |
| 8,632,432 | B2 | 1/2014 | Bissig et al. |
| 8,656,696 | B2 | 2/2014 | Bruch et al. |
| 8,677,726 | B2 | 3/2014 | Wesson et al. |
| 8,852,368 | B2 | 10/2014 | Herbert et al. |
| 2003/0024770 | A1 | 2/2003 | O'Donnell et al. |
| 2011/0000746 | A1 | 1/2011 | Pelto-Huikko et al. |
| 2011/0259677 | A1 | 10/2011 | Dudde et al. |
| 2012/0304874 | A1 | 12/2012 | Rava |
| 2013/0042939 | A1 | 2/2013 | Wesson et al. |
| 2013/0171463 | A1 | 7/2013 | Chang et al. |
| 2013/0206516 | A1 | 8/2013 | Pelto-Huikko et al. |
| 2014/0027211 | A1 | 1/2014 | Wesson et al. |
| 2015/0017436 | A1 | 1/2015 | Krishnan et al. |

FOREIGN PATENT DOCUMENTS

| | | | |
|---|---|---|---|
| EP | 2305591 | A1 | 4/2011 |
| FR | 1389895 | A | 2/1965 |
| GB | 821427 | A | 10/1959 |
| WO | 2015126359 | A1 | 8/2015 |

OTHER PUBLICATIONS

Written Opinion for International Application No. PCT/US2016/051667; International Filing Date Sep. 14, 2016; dated Dec. 21, 2016; 5 pages.

WOVEN ELEVATOR BELT WITH MULTIFUNCTIONAL COATINGS

CROSS REFERENCE TO RELATED APPLICATIONS

This application is a National Stage application of PCT/US2016/051667, filed Sep. 14, 2016, which claims the benefit of U.S. Provisional Application No. 62/218,275, filed Sep. 14, 2015, both of which are incorporated by reference in their entirety herein.

BACKGROUND

The subject matter disclosed herein relates to belts such as those used in elevator systems for suspension and/or driving of the elevator car and/or counterweight.

Conventional elevator systems use rope formed from steel wires as a lifting tension load bearing member. Other systems utilize a belt formed from a number of steel cords, formed from steel wires, retained in a polymer jacket formed from, for example, thermoplastic polyurethane. The cords act as the load supporting tension member, while the jacket holds the cords in a stable position relative to each other, and provides a frictional load path to provide traction for driving the belt.

Monolithic jacket materials used to encase tension members can pose manufacturing challenges. In addition, altering composition such as through the addition of fillers to gain performance enhancement such as fire resistance, corrosion resistance, wear resistance, traction and/or mechanical performance can have many challenges. Adding filler or otherwise changing material composition can make processing the resulting material much more challenging and issues with filler/polymer compatibility often occur. All of these issues must be addressed without sacrificing traction, durability, and other key performance metrics. One approach to alleviating these challenges is to take a composite approach which decouples certain critical performance properties. This can be achieved by replacing a monolithic polymer jacket with a composite fabric and coating system. The fabric predominantly functions as the structural component of the composite jacket while maintaining flexibility, and the coating, or multiplicity thereof, predominantly functions to provide traction and other performance properties.

The composite fabric typically includes yarns or other non-metallic fibers that are woven together with the steel cords, or otherwise used to position the cords. The woven belt is also saturated or coated with an elastomeric binder. This is done to produce a selected amount of traction between the belt and a traction sheave that drives the belt, while reducing noise that sometimes results from the use of elastomeric belts. The steel cords in the woven belt are the primary load bearing tension members, the yarns and the binder material act to keep the cords in place and provide a traction surface. The use of yarn materials also expands the physical properties of the construction beyond what is possible from thermoplastic or extrudable elastomer jacket materials.

SUMMARY

In one embodiment, a belt for suspending and/or driving an elevator car includes a plurality of tension elements extending longitudinally along a length of the belt and a plurality of fibers interlaced with the plurality of tension elements forming a composite belt structure. A coating at least partially encapsulates the composite belt structure to improve two or more operational characteristics of the belt.

Additionally or alternatively, in this or other embodiments the coating is applied to the tension elements of the belt.

Additionally or alternatively, in this or other embodiments the coating is positioned between the tension elements and the plurality of fibers.

Additionally or alternatively, in this or other embodiments the coating is applied to the plurality of fibers.

Additionally or alternatively, in this or other embodiments the coating enhances one or more of tension element protection, fiber protection, or traction performance of the elevator belt.

Additionally or alternatively, in this or other embodiments the coating includes a base material and one or more additives.

Additionally or alternatively, in this or other embodiments the base material includes polyurethane, styrene butadiene rubber (SBR), nitrile rubber (NBR), acrylonitrile butadiene styrene (ABS), SBS/SEBS plastics, silicone, other curable diene based rubber, EPDM rubber, or neoprene.

Additionally or alternatively, in this or other embodiments the one or more additives includes a zinc or tin material to improve corrosion resistance of the plurality of tension elements.

Additionally or alternatively, in this or other embodiments the one or more additives includes one or more of boron nitride, graphite, $MoS_2$, zinc phosphate, manganese phosphate or silicone materials to reduce friction of the plurality of tension elements.

Additionally or alternatively, in this or other embodiments the one or more additives includes one or more of silica, rubber, silicone, or talc to enhance traction performance of the belt.

Additionally or alternatively, in this or other embodiments the one or more additives includes one or more of organic nano- or micro-fibers, such as aramid, Kevlar, nylon or polyester to enhance traction performance or cut-tear resistance of the belt.

In another embodiment, a method of forming a belt for suspending and/or driving an elevator car includes forming a plurality of tension elements and arraying the plurality of tension elements longitudinally along a belt. A plurality of fibers are interlaced with the plurality of tension elements to form a composite belt structure. A coating is applied to at least partially encapsulate the composite belt structure to improve at least two operational characteristics of the belt.

Additionally or alternatively, in this or other embodiments the coating is applied to the plurality of tension elements prior to interlacing the plurality of fibers with the plurality of tension elements.

Additionally or alternatively, in this or other embodiments the coating enhances corrosion resistance of the plurality of tension elements.

Additionally or alternatively, in this or other embodiments the coating is applied to the belt after interlacing the plurality of fibers with the plurality of tension elements.

Additionally or alternatively, in this or other embodiments the coating enhances at least one of wear performance and traction performance of the belt.

Additionally or alternatively, in this or other embodiments the coating is applied to the individual tension elements each covered with braided or woven fabric and the fabric covered tension elements are assembled into a belt held together by the coating material.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Figure 1A:
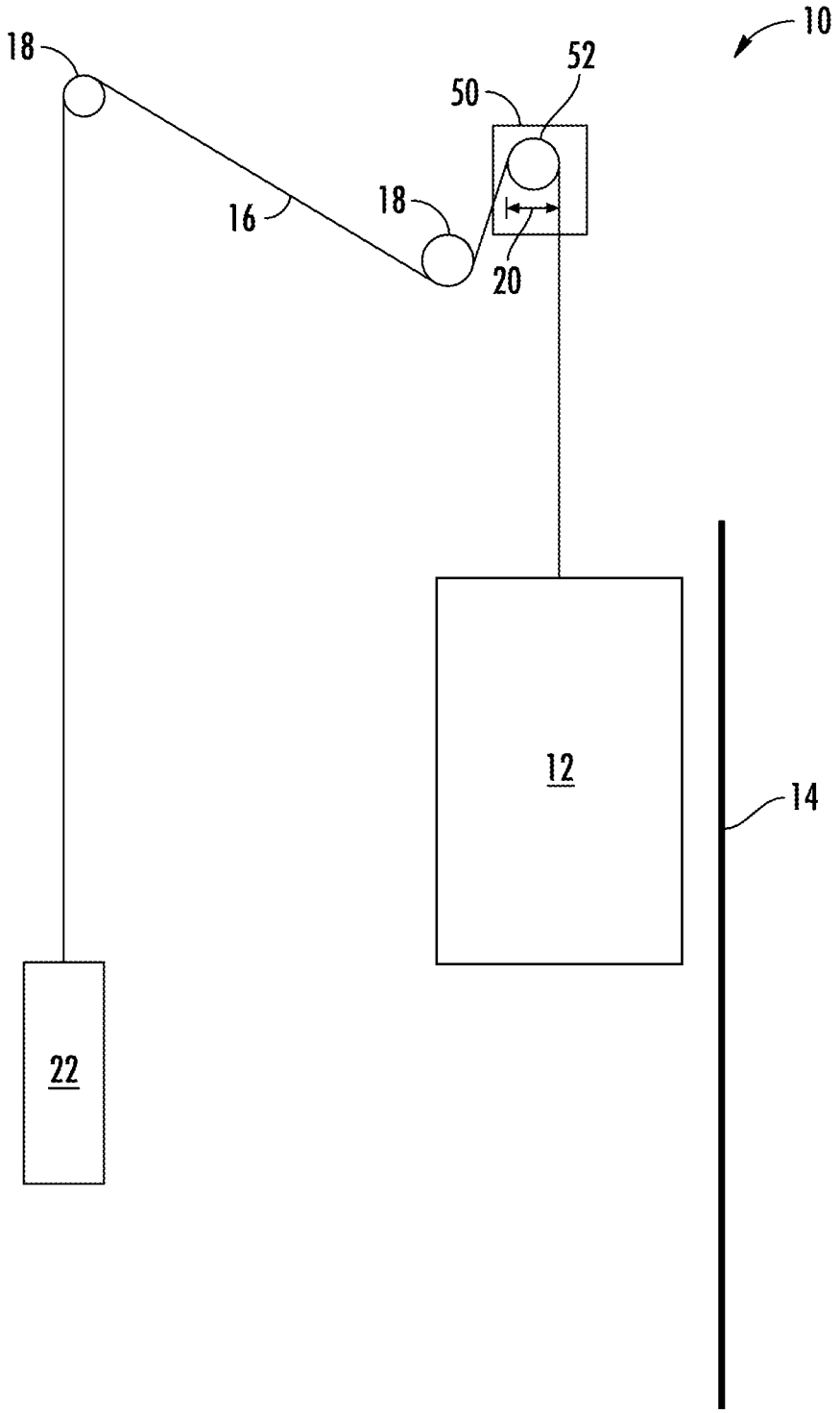
FIG. 1A is a schematic of an exemplary elevator system having a 1:1 roping arrangement.
Figure 1B:
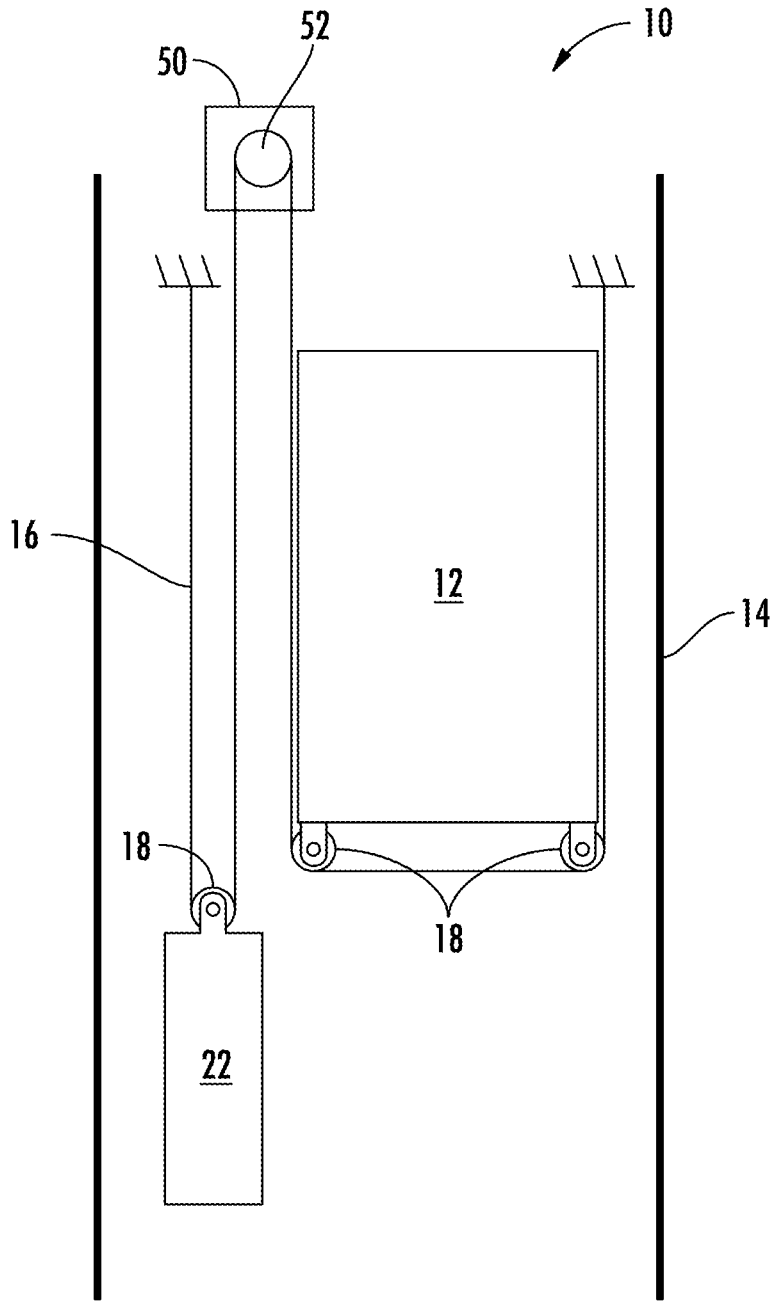
FIG. 1B is a schematic of another exemplary elevator system having a different roping arrangement.
Figure 1C:
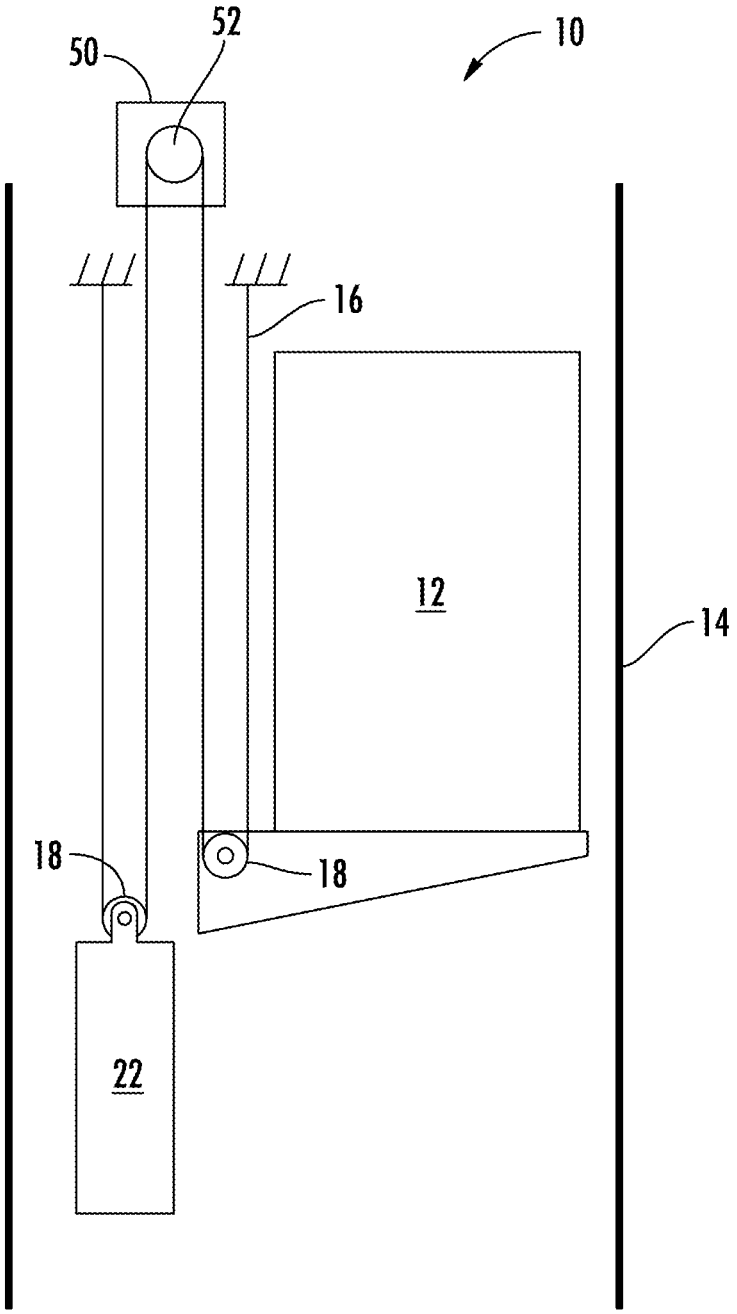
FIG. 1C is a schematic of another exemplary elevator system having a cantilevered arrangement.

Shown in FIGS. 1A, 1B and 1C are schematics of exemplary traction elevator systems 10. Features of the elevator system 10 that are not required for an understanding of the present disclosure (such as the guide rails, safeties, etc.) are not discussed herein. The elevator system 10 includes an elevator car 12 operatively suspended or supported in a hoistway 14 with one or more belts 16. The one or more belts 16 interact with one or more sheaves 18 to be routed around various components of the elevator system 10. The one or more belts 16 could also be connected to a counterweight 22, which is used to help balance the elevator system 10 and reduce the difference in belt tension on both sides of the traction sheave during operation.

The sheaves 18 each have a diameter 20, which may be the same or different than the diameters of the other sheaves 18 in the elevator system 10. At least one of the sheaves would be a traction sheave 52. The traction sheave 52 is driven by a machine 50. Movement of drive sheave by the machine 50 drives, moves and/or propels (through traction) the one or more belts 16 that are routed around the traction sheave 52.

At least one of the sheaves 18 could be a diverter, deflector or idler sheave. Diverter, deflector or idler sheaves are not driven by a machine 50, but help guide the one or more belts 16 around the various components of the elevator system 10.

In some embodiments, the elevator system 10 could use two or more belts 16 for suspending and/or driving the elevator car 12. In addition, the elevator system 10 could have various configurations such that either both sides of the one or more belts 16 engage the one or more sheaves 18 (such as shown in the exemplary elevator systems in FIG. 1A, 1B or 1C) or only one side of the one or more belts 16 engages the one or more sheaves 18.

FIG. 1A provides a 1:1 roping arrangement in which the one or more belts 16 terminate at the car 12 and counterweight 22. FIGS. 1B and 1C provide different roping arrangements. Specifically, FIGS. 1B and 1C show that the car 12 and/or the counterweight 22 can have one or more sheaves 18 thereon engaging the one or more belts 16 and the one or more belts 16 can terminate elsewhere, typically at a structure within the hoistway 14 (such as for a machineroomless elevator system) or within the machine room (for elevator systems utilizing a machine room). The number of sheaves 18 used in the arrangement determines the specific roping ratio (e.g. the 2:1 roping ratio shown in FIGS. 1B and 1C or a different ratio). FIG. 1C also provides a so-called rucksack or cantilevered type elevator. The present embodiments could also be used on elevator systems other than the exemplary types shown in FIGS. 1A, 1B and 1C.

The belts 16 are constructed to have sufficient flexibility when passing over the one or more sheaves 18 to provide low bending and shear stresses, meet belt life requirements and have smooth operation, while being sufficiently strong to be capable of meeting strength requirements for suspending and/or driving the elevator car 12.

Figure 2:
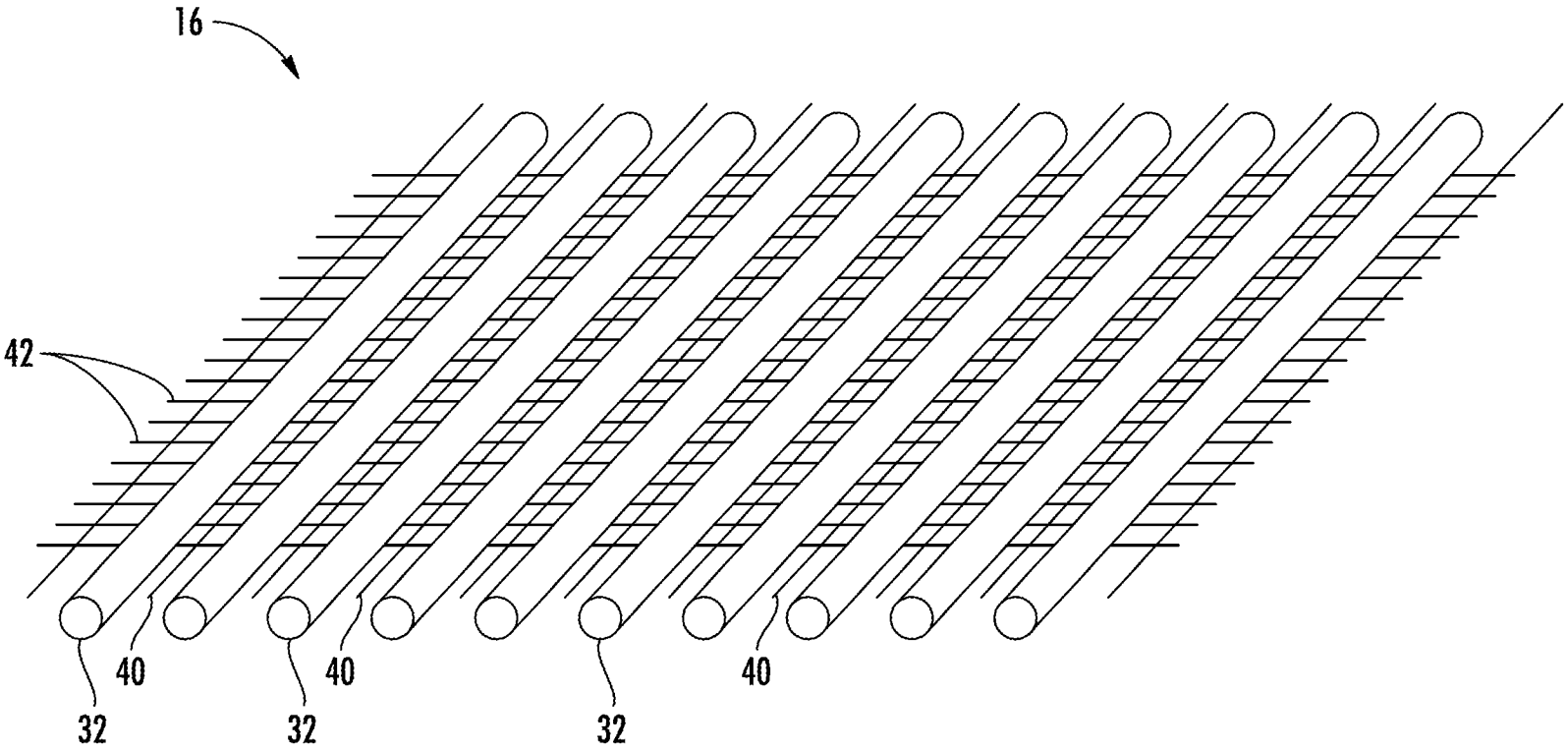
FIG. 2 is a plan view of an embodiment of an elevator belt.
Figure 3:
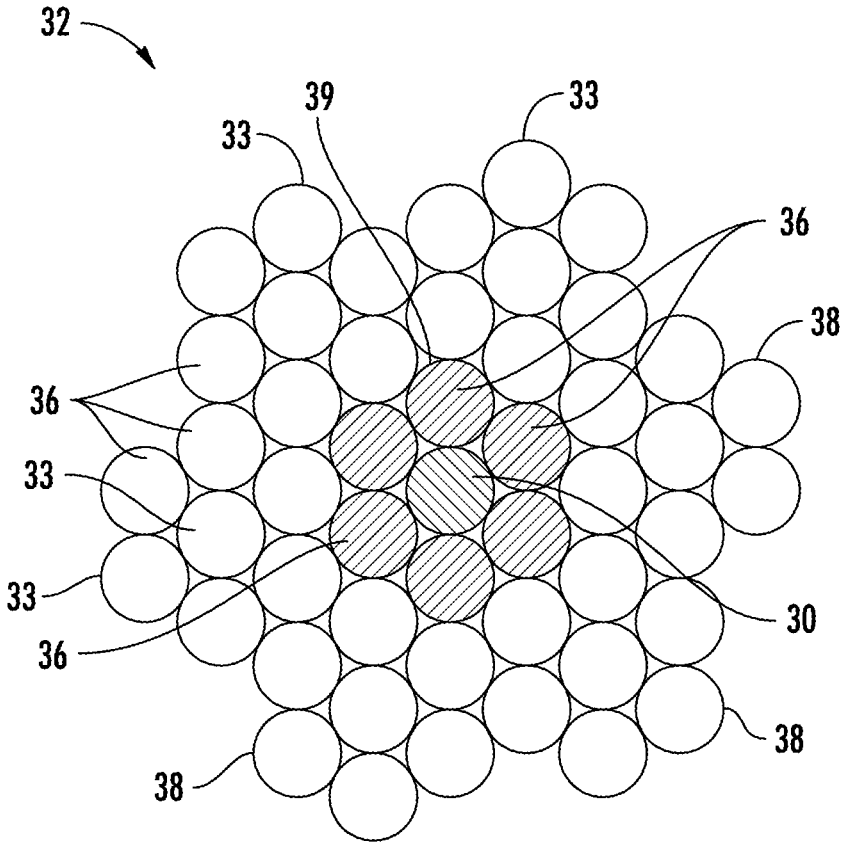
FIG. 3 is a cross-sectional view of an embodiment of a tension element of an elevator belt.

FIG. 2 provides a schematic of an exemplary belt 16 construction or design. The belt 16 includes a plurality of tension elements 32 extending longitudinally along the belt 16. As shown in FIG. 3, in some embodiments, the tension elements 32 are cords formed from a plurality of steel wires 36, which may be arranged into strands 38. Referring again to FIG. 2, the tension elements 32 are arranged generally parallel to each other and extend in a longitudinal direction that establishes a length of the belt 16. The tension elements 32 are woven, knitted, braided or otherwise intermeshed with one or more types of fibers to form a composite belt 16. In one embodiment, shown in FIG. 2, the fibers include a plurality of warp fibers 40 extending longitudinally parallel to the tension elements 32 and a plurality of weft fibers 42 extending laterally across the belt 16, in some embodiments at an angle of 90 degrees relative to the tension elements 32 and the warp fibers 40. In other embodiments, the weft fibers 42 may be placed at other angles relative to the tension elements 32, such as 75 degrees and 105 degrees, or 60 degrees and 120 degrees. These angles, however, are merely examples, and one skilled in the art will readily appreciate that other angles may be utilized. The tension elements 32, warp fibers 40 and weft fibers 42 are interlaced into a woven structure, which in some embodiments also includes one or more edge fibers 50 extending parallel to the tension elements 32. While in FIG. 2, the weft fibers 42 are at a 90 degree angle relative to the warp fibers 40 and the tension elements 32 and woven together, it is to be appreciated that other angles and other methods of interlacing the tension elements 32 with the fibers 40, 42 may be utilized in forming the belt 16. These methods include, but are not limited to, knitting and braiding. In some embodiments, more than one of the above methods may be utilized to form the belt 16.

While the embodiment described above is illustrated in FIG. 2, it is to be appreciated that the present technology may be readily applied to other belt configurations, such as belt 16 configurations where tension elements 32 are individually interlaced in warp fibers 40 and weft fibers 42 and are later combined into belt 16.

Figure 4:
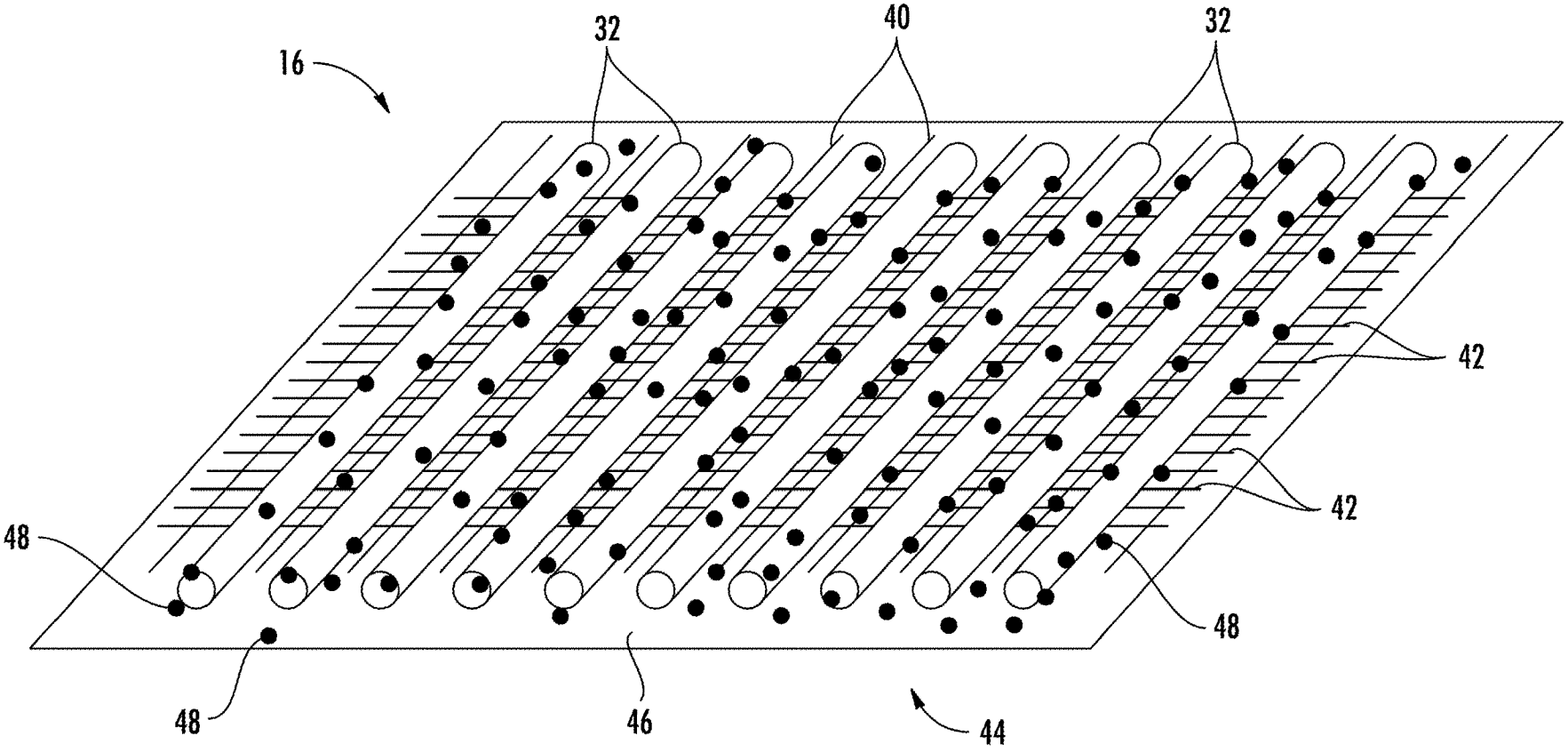
FIG. 4 is a schematic view of an embodiment of a composite elevator belt.

Referring to FIG. 4, one or more coatings 44 are applied to the belt 16, at least partially covering and/or encapsulating the composite structure of the tension elements 32, the warp fibers 40 and the weft fibers 42. The coating 44 comprises a base material 46, and in some embodiments includes one or more additives 48 to tailor or enhance certain properties of the coating 44 and/or the belt 16 as a whole. Examples of base materials for the coating 44 include, but are not limited to polyurethane, styrene butadiene rubber (SBR), nitrile rubber (NBR), acrylonitrile butadiene styrene (ABS), SBS/SEBS plastics, silicone, EPDM rubber, other curable diene based rubber, neoprene, non-curing thermoplastic elastomers, curable extrudable rubber materials, or the like, each of which can be in the form of a solution, emulsion, prepolymer or other fluid phase.

As stated, the coating includes one or more additives 48 to improve characteristics of the belt 16. The additives 48 are selected to improve a combination of belt characteristics, serving a primary function such as one of cord reinforcement protection, fabric bonding and protection, or traction performance. Further, the additives 48 or combination of additives 48 are selected to serve not just the primary function, but to serve a secondary function also, such as another of cord reinforcement protection, fabric bonding and protection, improved processability during manufacture, toughness, oxidation and/or UV protection, traction performance, electrical isolation, or fire resistance.

Coatings 44 for enhancing reinforcement protection, such as of the tension elements 32, will be the most effective if the coatings are in intimate contact with the reinforcement, the steel or aramid tension elements 32. These coatings 44 would be easiest to apply and most controlled if they are applied between the cord closing operation, when the steel wires 36 are formed into the tension members, and formation of fabric around the tension member assemblies via the warp fibers 40 and weft fibers 42, however could still be applied even after the fabric is constructed (i.e. knitted, braided, woven) around the tension element 32. Coatings 44 that would be applicable for cord reinforcement enhancement include thin film coatings that have corrosion inhibiting additives, such as zinc or tin, or friction reducing components, such as boron nitride, graphite, silicone, zinc phosphate, or manganese phosphate. Coatings 44 may also be applied in ways to obtain preferential alignment of additives 48 for additional protection such as layer-by-layer coatings that could provide corrosion resistance or internal lubrication for wear resistance while also providing electrical isolation to aid in health monitoring, at least for steel tension elements 32.

The fabric construction around the belt 16 via warp fibers 40 and weft fibers 42 must be durable against mechanical and environmental influences. Ideally, coatings 44 applied to the fabric will improve fabric durability against both of these influences. From a mechanical standpoint, fabric must be resistant to abrasion from the traction surface of the belt 16 interactive with the traction sheave 52, and from cut/tear from the reinforcement interface with the tension elements 32. The coating 44 must also reduce fiber-fiber contact and therefore fiber fraying. Mechanical enhancement of the fabric is also desirable to provide in-plane stiffness which enables tracking of a belt over a crowned sheave. Thick elastomeric coatings 44 can provide a good coating from a mechanical standpoint and additives 48 (such as carbon black, graphene, clay, and others) can be added to increase environmental stability. The one or more additives may include one or more of organic nano- or micro-fibers, such as aramid, Kevlar, nylon or polyester to enhance traction performance or cut-tear resistance of the belt. Further, several coating passes, each with different additives and concentrations, can be applied to achieve the desired performance.

Coatings 44 for enhancing traction performance of the belt 16 are best applied at the outer surface of the belt 16, but ideally would penetrate sufficiently through the fabric such that when the fabric wears, the traction coating 44 still performs its function. Such coatings may be applied to the fibers 40, 42 prior to interlacing with the tension elements 32, or in other embodiments may be applied after interlacing with the tension elements 32. Traction coatings 44 must be durable and have a traction performance high enough to allow sufficient duty load to be lifted, while low enough to ensure safe emergency braking and other required functions of the elevator system 10. The traction coating 44 may be utilized to increase or decrease traction depending on the belt traction of fabric belt 16 without a traction coating. Different fillers or additives 48 may be used to increase (hard, coarse particles such as silica or high surface energy materials) or decrease (soft or low surface energy particles or additives such as rubber, silicone, or talc) traction performance of the belt 16.

Additionally, coatings may be provided that enhance other belt 16 properties, such as fire resistance, noise reduction, damping performance, or the like. Coatings 44 may be applied using a variety of techniques including dip, spray, blade, resin transfer, and pultrusion. In some embodiments, coatings 44 are neat resin (100% solids) or alternatively diluted coatings in water, solvent, or a mixture of each. Ideally one coating 44 will provide superior tension element 32 protection, fabric protection, and belt 16 traction, but certain considerations may make it more appealing to have multiple different coatings provide a certain primary function Examples of multifunctional coatings 44 include fluoropolymer based coatings and fluoropolymer additives in a non-fluoropolymer resin which in combination can provide traction reduction, environmental resistance, and fire-resistance. Another example of a multifunctional coating 44 is a rubber coating that contains inorganic fillers such as talc or nanoclays that provide multiple simultaneous performance enhancements such as traction stability and fire-resistance.

Another example of a multifunctional coating 44 is a compound of cured pre-elastomers into thermoplastic materials. Another example is a blend or alloy of two different elastomers that provide enhanced flow during manufacturing without degradation of mechanical properties. Yet another example is a compound of a relatively low molecular weight adhesive into a base elastomer, with the adhesive migrating preferentially to cord and fiber surfaces during manufacturing, thereby enhancing wetting, adhesion and protection.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments have been described, it is to be understood that aspects of the disclosure may include only some of the described embodiments. Accordingly, the disclosure is not to be seen as limited by the foregoing description, but is only limited by the scope of the appended claims.

The invention claimed is:

1. A belt for suspending and/or driving an elevator car, comprising:

a plurality of tension elements extending longitudinally along a length of the belt;

a plurality of fibers interlaced with the plurality of tension elements forming a composite belt structure; and a coating at least partially encapsulating the composite belt structure to improve two or more operational characteristics of the belt;

wherein the coating comprises a base material and one or more additives; and wherein the one or more additives are configured improve the two or more operational characteristics, and the two or more operational characteristics are two or more of tension element reinforcement protection, fabric bonding performance, traction performance, toughness, oxidation prevention, ultraviolet light protection, electrical isolation or fire resistance the coating further including:

a first coating portion applied directly to the tension elements of the belt, the first coating portion including one or more of a zinc or tin material to improve corrosion resistance of the plurality of tension elements or one or more of boron nitride, graphite, $MoS_2$, zinc phosphate, manganese phosphate or silicone materials to reduce friction of the plurality of tension elements; and a second coating portion applied to the woven structure, the second coating portion different from the first coating portion.

2. The belt of claim 1, wherein the coating is disposed between the tension elements and the plurality of fibers.

3. The belt of claim 1, wherein the coating is applied to the plurality of fibers.

4. The belt of claim 1, wherein the coating enhances one or more of tension element protection, fiber protection, or traction performance of the elevator belt.

5. The belt of claim 1, wherein the base material comprises polyurethane, styrene butadiene rubber (SBR), nitrile rubber (NBR), acrylonitrile butadiene styrene (ABS), SBS/SEBS plastics, silicone, other curable diene based rubber, EPDM rubber, or neoprene.

6. The belt of claim 1, wherein the one or more additives includes one or more of boron nitride, graphite, $MoS_2$, zinc phosphate, manganese phosphate or silicone materials to reduce friction of the plurality of tension elements.

7. The belt of claim 1, wherein the one or more additives includes one or more of silica, rubber, silicone, or talc to enhance traction performance of the belt.

8. The belt of claim 1, wherein the one or more additives includes one or more of organic nano- or micro-fibers, such as aramid, nylon or polyester to enhance traction performance or cut-tear resistance of the belt.

9. A method of forming a belt for suspending and/or driving an elevator car comprising:

forming a plurality of tension elements;

arraying the plurality of tension elements longitudinally along a belt;

interlacing a plurality of fibers with the plurality of tension elements to form a composite belt structure;

applying a coating to at least partially encapsulate the composite belt structure to improve at least two operational characteristics of the belt;

wherein the coating comprises a base material and one or more additives; and wherein the one or more additives are configured improve the two or more operational characteristics, and the two or more operational characteristics are two or more of tension element reinforcement protection, fabric bonding performance, traction performance, toughness, oxidation prevention, ultraviolet light protection, electrical isolation or fire resistance;

further comprising applying a first coating portion to the plurality of tension elements prior to interlacing the plurality of fibers with the plurality of tension elements, the first coating portion including one or more of a zinc or tin material to improve corrosion resistance of the plurality of tension elements or one or more of boron nitride, graphite, $MoS_2$, zinc phosphate, manganese phosphate or silicone materials to reduce friction of the plurality of tension elements; and applying a second coating portion to the woven structure, the second coating portion different from the first coating portion.

10. The method of claim 9, wherein the coating enhances corrosion resistance of the plurality of tension elements.

11. The method of claim 9, further comprising applying the coating to the belt after interlacing the plurality of fibers with the plurality of tension elements.

12. The method of claim 11, wherein the coating enhances at least one of wear performance and traction performance of the belt.

13. The method of claim 9, further comprising applying the coating to the individual tension elements each covered with braided or woven fabric and assembling the fabric covered tension elements into a belt held together by the coating material.

* * * * *